US006851974B2

(12) United States Patent
Doutrich

(10) Patent No.: US 6,851,974 B2
(45) Date of Patent: Feb. 8, 2005

(54) SHROUD RETENTION WAFER

(75) Inventor: Ray C. Doutrich, Lebanon, PA (US)

(73) Assignee: FCI Americas Technology, Inc., Reno, NV (US)

( * ) Notice: Subject to any disclaimer, the term of this patent is extended or adjusted under 35 U.S.C. 154(b) by 72 days.

(21) Appl. No.: 10/255,355

(22) Filed: Sep. 26, 2002

(65) Prior Publication Data

US 2003/0022564 A1 Jan. 30, 2003

Related U.S. Application Data

(63) Continuation of application No. 09/423,885, filed as application No. PCT/US98/09946 on May 15, 1998, now Pat. No. 6,485,330.

(60) Provisional application No. 60/046,621, filed on May 15, 1997.

(51) Int. Cl.[7] ..... H01R 13/73

(52) U.S. Cl. ..... 439/572

(58) Field of Search ..... 439/571, 572, 439/78, 733.1, 347, 376, 545, 304

(56) References Cited

U.S. PATENT DOCUMENTS

| | | | | |
|---|---|---|---|---|
| 2,976,345 A | | 3/1961 | Whitted | 174/153 R |
| 3,815,077 A | | 6/1974 | Anhalt et al. | 439/70 |
| 4,451,507 A | | 5/1984 | Beltz et al. | 427/240 |
| 4,548,450 A | | 10/1985 | Reimer et al. | 439/82 |
| 4,601,527 A | | 7/1986 | Lemke | 439/81 |
| 4,655,518 A | | 4/1987 | Johnson et al. | 436/62 |
| 4,749,373 A | | 6/1988 | Brekosky et al. | 439/595 |
| 4,775,333 A | | 10/1988 | Grider et al. | 439/736 |
| 4,808,118 A | | 2/1989 | Wilson et al. | 439/95 |
| 4,836,791 A | | 6/1989 | Grabbe et al. | 439/79 |
| 4,869,677 A | | 9/1989 | Johnson et al. | 439/80 |
| 5,015,192 A | | 5/1991 | Welsh et al. | 439/83 |
| 5,110,307 A | | 5/1992 | Rapoza | 439/566 |
| 5,151,036 A | | 9/1992 | Fusselman et al. | 439/108 |
| 5,169,324 A | | 12/1992 | Lemke et al. | 439/101 |
| 5,215,473 A | | 6/1993 | Brunker et al. | 439/108 |
| 5,263,882 A | * | 11/1993 | Peterson | 439/733.1 |
| 5,344,341 A | | 9/1994 | Yoshimo | 439/607 |
| 5,522,730 A | | 6/1996 | Soes et al. | 439/78 |
| 5,542,860 A | | 8/1996 | Bandura et al. | 439/567 |
| 6,322,393 B1 | | 11/2001 | Doutrich et al. | 439/607 |

FOREIGN PATENT DOCUMENTS

DE 39 366 466 A1 5/1991

* cited by examiner

*Primary Examiner*—Neil Abrams
(74) *Attorney, Agent, or Firm*—Woodcock Washburn LLP

(57) ABSTRACT

An insulative shroud retention wafer for an electrical connector allowing for an optimization of pin placements of the electrical connector is provided. In an illustrative embodiment the shroud retention wafer comprises a first (66), second (68), third (70), and fourth (72) cylindrical members, each having an axial pin receiving aperture (86) and an axial center line (78, 80) extending through the pin receiving aperture (86). Furthermore, the cylindrical members maintain at least one protuberance (100). In operation, the cylindrical members of the shroud retention wafer couple with pins of the electrical connector to realize an electrical connection. Specifically, the protuberance (100) causes collapse of the cylinders (66,68,70,72) allowing for better gripping of pins of the electrical connector. The arrangement of the cylinders (66,68,70,72) of the shroud retention (28) wafer maximizes the number of cylindrical members on the wafer allowing for optimization of pin placement.

11 Claims, 4 Drawing Sheets

SHROUD RETENTION WAFER

This application is a continuation of U.S. patent application Ser. No: 09/423,885 filed Dec. 29, 1999 now U.S. Pat. No. 6,485,330, the entirety of which is incorporated herein by reference and which is a 371 of PCT/US98/09946 May 15, 1998 and which claims benefit of Provisional appln Ser. No. 60/046,621 filed May. 15, 1997.

BACKGROUND OF THE INVENTION

1. Field of the Invention

The present invention relates to electrical connector and more particularly to arrangements for securing pins in electrical connectors.

2. Brief Description of Prior Developments

Typical prior art shrouds have a designed interference with a mating pin. In the application process the shroud is placed on the pin tip and, with some sort of toe and press, is pushed down the pin against the rear side of a back panel.

One of the difficulties associated with such a procedure is knowing if the shroud is properly aligned with the pins. That is, knowing if the shroud is misplaced by perhaps one position. Another problem, is that the shroud needs to be held on the pin tips while a tool is placed within it and it is placed into a press. It is also found that as pressure is applied to the shroud, the pin may have a tendency to bend causing pin deformations since the load is being placed on a long slender column.

As is disclosed in European Patent Application No. 578 487 A (U.S. Pat. No. 5,552,730), it is known in the art to provide a structure known as a locking plate or retention wafer between the shroud or housing and the circuit board or back panel. The arms fit in passageways in the base of the housing and these passageways include a camming surface for urging the gripping arms into contact with the pins. The disadvantage to the above arrangement described in European Patent Application No. 578 487 A is that the interacting protuberance and camming surfaces require the gripping arms or cylindrical members to be displaced from each other at a relatively large distance. The present invention aims to ameliorate the shortcomings of the described prior art by providing an electrical connector having a shroud retention wafer that acts to more easily cooperate with the pins of the electrical connector thereby avoiding the necessity of having such pins to be displaced from each other by large distances and protecting against possible pin deformations.

From the foregoing it is appreciated that there exists a need for an electrical connector to overcome the disadvantages of the prior art. By having, an electrical connector with a shroud retention wafer, the cylindrical members or gripping arms of the electrical connector would not be displaced over a large distance from each other.

SUMMARY OF THE INVENTION

It is an object of the present invention to provide a shroud retention wafer which allows easier shroud application than typical shrouds.

It is another object to provide a shroud retention wafer which produces less damage to pins than typical shrouds.

It is also an object of this invention to provide a shroud retention wafer which provides better retention than typical shrouds.

The insulative shroud retention wafer of this invention includes a planar base member having a first and a second side. There are also first, second, third and fourth cylindrical members each having an axial pin receiving aperture and an axial center line extending said pin receiving aperture. These cylindrical members extend from the first side of the planar base member, and these cylindrical members are positioned in an arrangement such that a first longitudinal center line extends through the axial center line of the first and second cylindrical members. A second longitudinal center line extends in parallel spaced retention to the first longitudinal center line through the axial center lines of the third and fourth cylindrical members. A first transverse center line extends through the centerlines of the first and third cylindrical members. A second traverse center line extends through the center line of the second and fourth cylindrical members. A protuberance is peripherally positioned on the first cylinder at least in part at a position between the first longitudinal center line and the first transverse center line.

BRIEF DESCRIPTION OF THE DRAWINGS

The present invention is further described with reference to the accompanying in which.

DETAILED DESCRIPTION OF THE PREFERRED EMBODIMENTS

Figure 1:
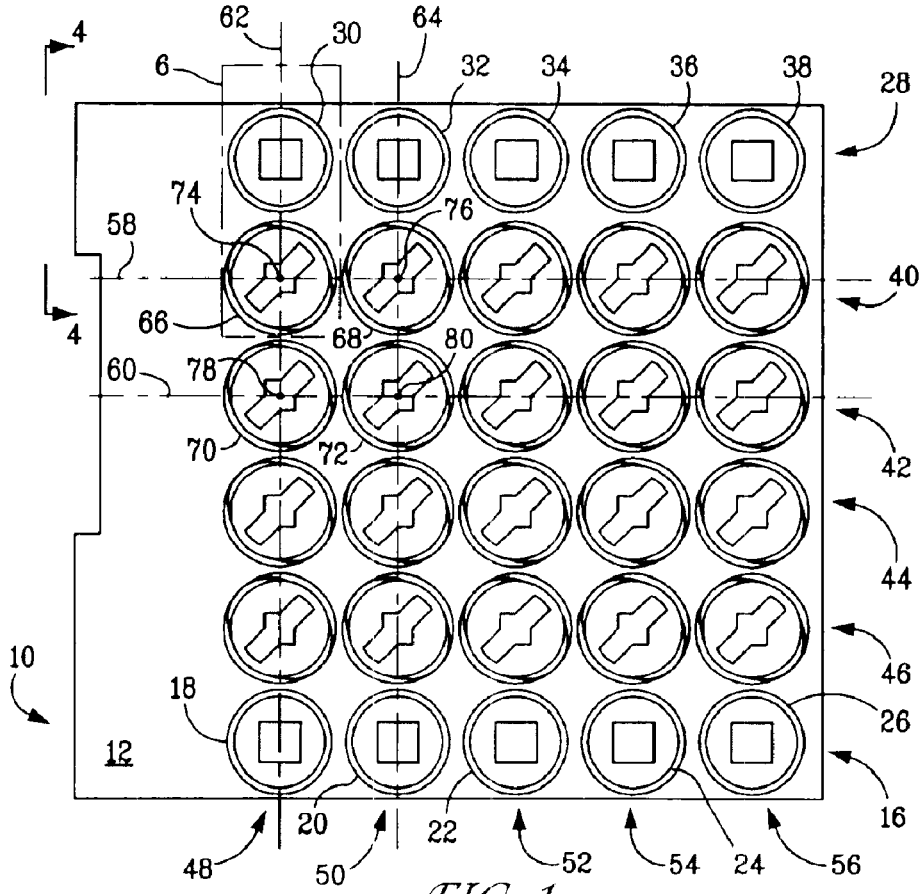
FIG. 1 is a top plan view of a preferred embodiment of the shroud retention wafer of the present invention.

The shroud retention wafer of the present invention is an improvement on the insulative plate with integral insulative sleeves that are shown respectively at numerals 57 and 56, PCT International Application No. WO 96/31922 (U.S. Pat. No. 5,967,844) published Oct. 10, 1996. The contents of this application are herein incorporated in their entirety by reference.

The wafer is composed of a thin molded base with cylindrical member on its top. Although 30 cylindrical members are shown in the disclosed embodiment, different numbers of cylindrical members may be used in various other situations. The inside coring of the 20 central cores has an odd shaped hole in it and two areas of added material on two opposing sides of the tower. The outside 5 cores on each end of the wafer are not pertinent to the wafers function. It will be appreciated that while the cores do not serve for pin retention they do serve for insulation and guidance. As pressure is applied to the opposing areas of added material, hereafter referred to as "protuberances", the cylindrical member will start to collapse, since there will preferably be approximately 8 mils of plastic on the cylindrical portion 90 degrees from the protuberances.

Figure 5:
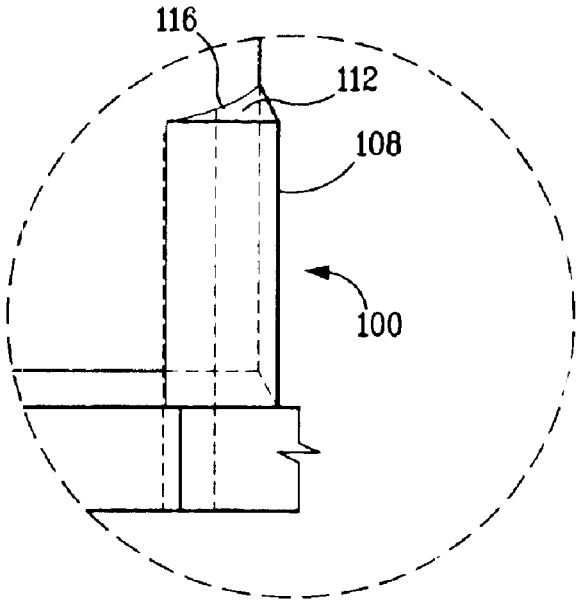
FIG. 5 is an enlarged view of circle 5 in FIG. 4.
Figure 5A:
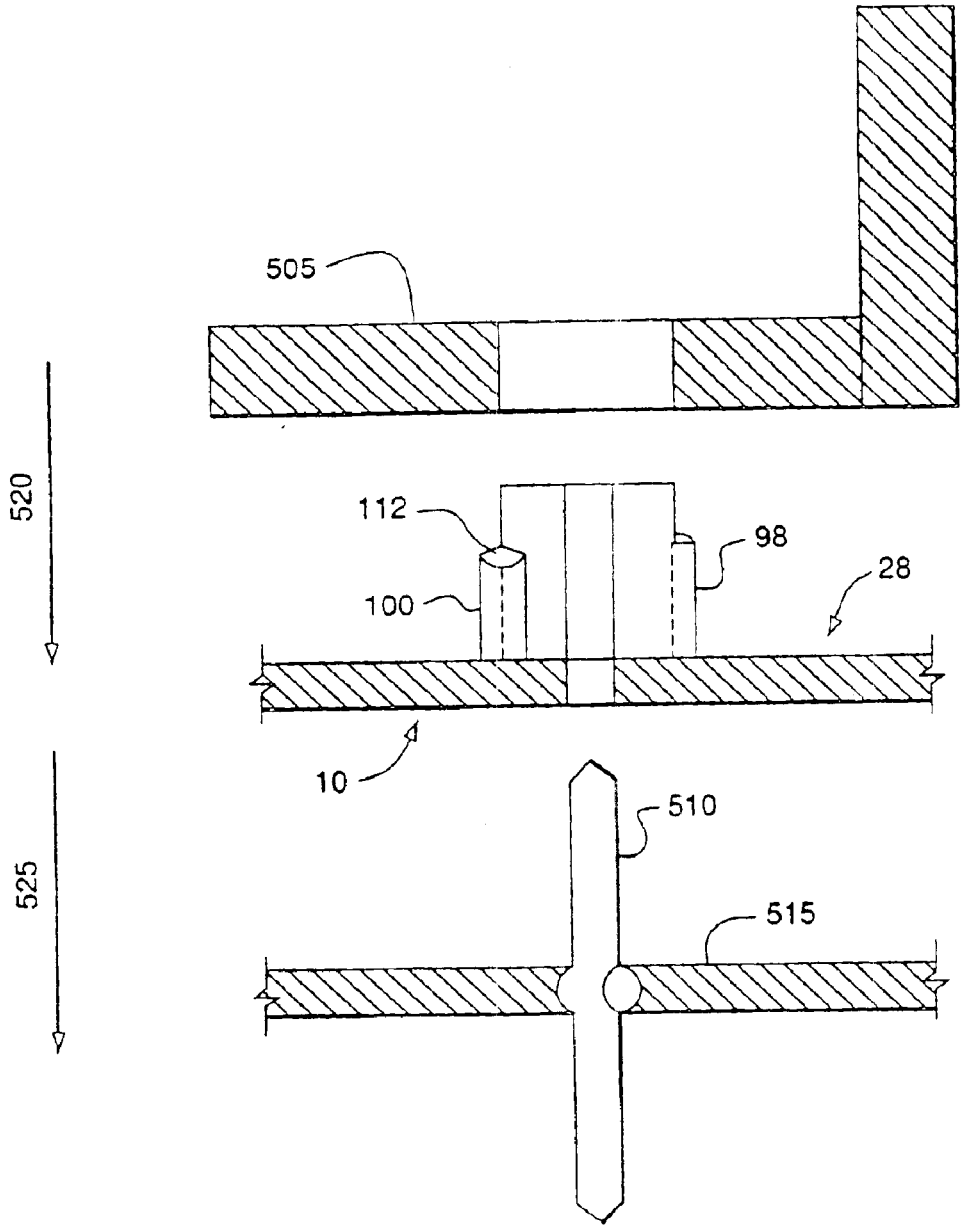
FIG. 5A illustrates the placement of the shroud, according to the invention.

This wafer as shown in FIG. 5A is used in conjunction with a die cast housing 505 which has a matching grid of holes similar to the wafer 28. In practice, the wafer 28 is placed by hand into the bottom of the casting 505 and pushed (as indicated by the set of arrows 520) to a specified depth. This piece is then supplied to a user as a shroud which is placed (as indicated by the set of arrows 525) on the rear side of a back panel 515 by hand. The shroud can be placed over the pins 510 protruding from the rear side of the back panel 515 and pushed down to the board of the rear panel until the wafer 28 contacts the board of the rear panel. At this point, the casting is not against the back panel. A piece of tooling is placed inside the casting, the back panel is then supported, and the casting 505 is fully inserted over the wafer 28. The wafer 28, which was already pushed against the back panel, cannot move as the casting 505 is pressed over it. This causes the protuberances 98 and 100 to be pushed toward the center of the core and the plastic core itself to press against the pin 510. This action causes the shroud to be securely fixed to the back panel 515. The present invention in operating in this manner offers distinct advantages over current retention wafers including the ability to affix a retention wafer over pins of a cooperating substrate without the need of excessive tooling, the ability to secure three piece contact, that is a die casting, a wafer, and a cooperating board of a back panel without the need of external fixtures, and the ability to secure an insulative shroud retention wafer that does not require the gripping elements to be displaced from each other at a relatively large distance.

Figure 2:
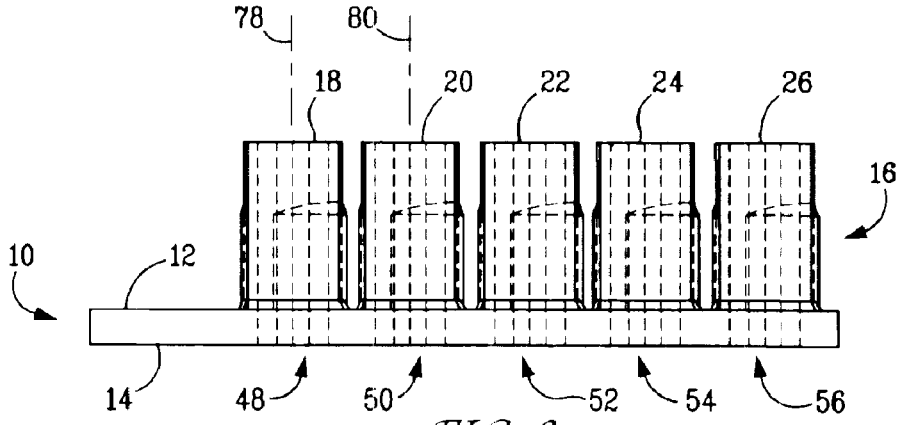
FIG. 2 is a side elevational view of the shroud retention wafer shown in FIG. 1.
Figure 3:
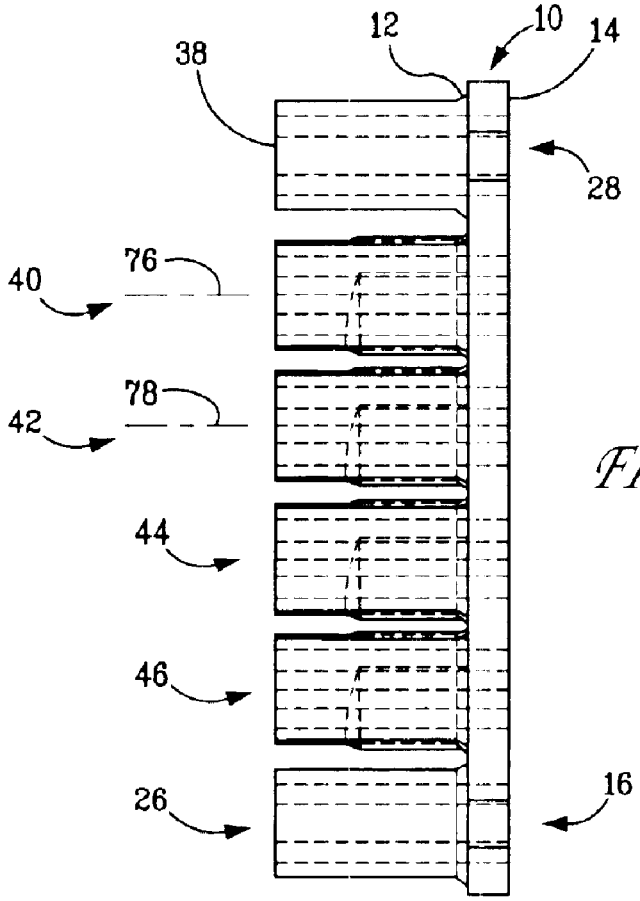
FIG. 3 is a front elevational view of the shroud retention wafer shown in FIG. 1.
Figure 4:
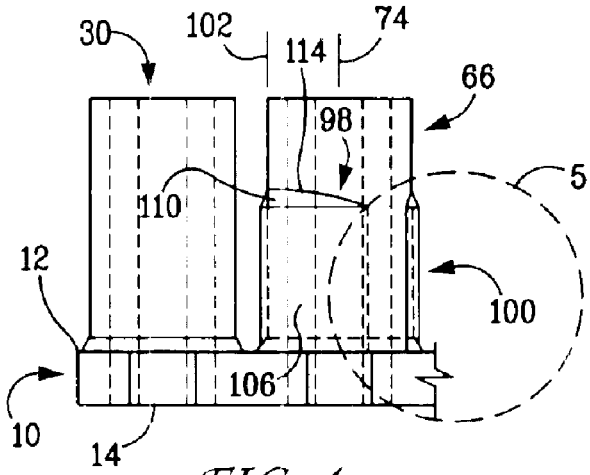
FIG. 4 is a rear view from 4—4 in FIG. 1.
Figure 6:
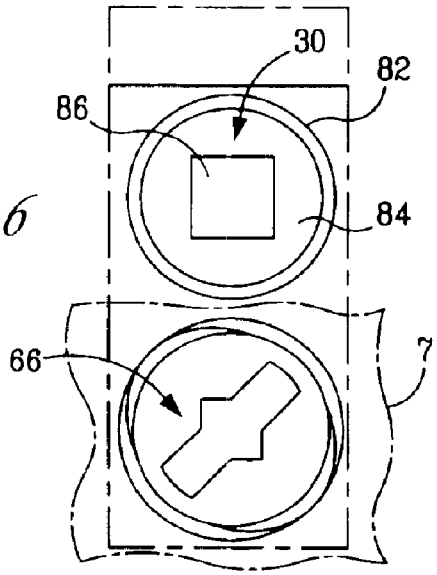
FIG. 6 is an enlarged view of Area 6 in FIG. 1.
Figure 7:
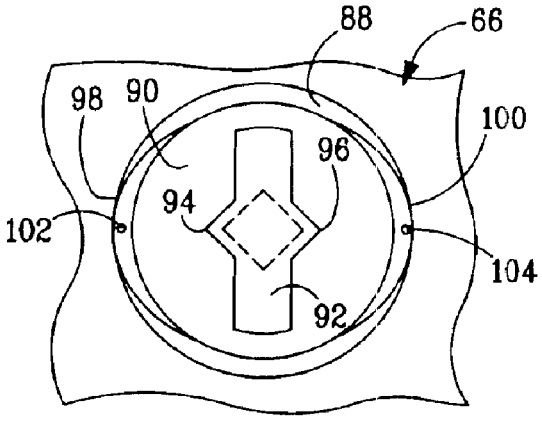
FIG. 7 is a further enlarged view of Area 7 in FIG. 6

Referring now to FIGS. 1–7 the insulative shroud is described. As shown in FIGS. 1–3, the retention wafer of the present invention includes a planar base section 10 which has a first upper side 12 and a second lower side 14. Extending upwardly from the upward side there is a first lateral row of cylindrical members shown generally at numeral 16 which is comprised of members 18, 20, 22, 24 and 26. There is also an opposed lateral row of cylindrical members made up of members 30, 32, 34, 36 and 38. Interposed between these lateral rows there are four medial rows shown generally at 40, 42, 44 and 46. The array of cylindrical members is also defined by a number of transverse rows shown generally at numerals 48, 50, 52, 54 and 56. Each of the medial rows has a center line as, for example, center line 58 of medial row 40 and center line 60 of medial row 42. Similarly, each of the transverse rows has a center line as, for example, center line 62 of row 48 and center line 64 of row 50. The medial rows include, for example, first cylinder 66 and second cylinder 68 in medial row 40 and third cylinder 70 and fourth cylinder 72 in medial row 42. Each of the cylindrical members in the medial row has a axial center line as, for example, first axial center line 74 in cylindrical member 66, second axial center line 76 and second cylindrical member 68, third axial center line 78 in third cylindrical member 70 and fourth axial center line 80 in fourth cylindrical member 74. As shown in FIGS. 6 and 7, each of the cylindrical members in the lateral rows such as cylindrical member 30 includes a peripheral base 82, a central body 84 and a central pin receiving aperture 86. While these lateral row pin receiving apertures allow for insulation of the pins they do not serve a gripping function. Each of the cylindrical members in the medial row as, for example, cylindrical member 66 has a peripheral base 88, and a central body 90. Its central pin receiving aperture through which the first axial center line 74 extends includes an elongated slot 92 and lateral recesses 94 and 96 which extend from the elongated 92 at a medial position in opposed directions. The lateral recesses 94 and 96 are triangularly shaped to receive a cross sectionally square pin. Recesses 94 and 96 are positioned within slot 92 such that upon receiving a pin from a cooperating electrical connector the first and second opposite portions of the cooperating pin perimeter are positioned in the recesses a first distance from the recess walls, and third and fourth opposite portions of the pin are positioned in said walled slot a second distance from said walled slot walls such that the second distance is greater than the first. A semi-circular shape for these recesses would be used for a round pin. Each of the cylindrical members in the medial rows also includes a pair of opposed protuberances 98 and 100. These protuberances have respectively center lines 102 and 104. Protuberance center lines 102 and 104 are radially aligned respectively with the opposed lateral recesses 94 and 96 in the pin receiving aperture. The protuberance center lines 102 and 104 are also displaced from the first longitudinal center line 58 and the first transverse center line 62 by an angle of 45 degrees. As shown in FIGS. 4 and 5, protuberances 98 and 100 also include vertical wall sections 106 and 108 respectively which overly the outer periphery of cylindrical member 66. These walls each cover about 90 degrees of the periphery of the cylindrical member 66. These walls have a arcuate upper sections 110 and 112 respectively which curve inwardly toward the cylinder member to form a cam surface. The wall also has upper edge 114 and 116 respectively which slope laterally and downwardly toward the base from their center lines. All of the cylindrical members in the medial rows are essentially similar to cylindrical member 66. Further, the protuberances in these rows are similarly positioned on the cylindrical members and have the same relative positions to the longitudinal and traverse center lines.

The shroud retention wafer described above may be fixed to a header prior to shipment of that header thus saving considerable time and effort during the placement of the header on a back panel or circuit board. It will also be appreciated that the positioning of the protuberances as described above on the cylindrical members maximizes the number of cylindrical members available allowing for efficient use of space on the wafer and when cooperating with pins of the electrical connector serve to protect against pin deformations by ensuring that sufficient force is provided to sustain an electrical connection without unduly offering unnecessary forces to pin corners.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An insulative shroud retention wafer, comprising:

a planar base having a first side and a second side; and at least one cylindrical member extending from the first side of the planar base, the cylindrical member comprising an aperture for accepting a pin, the aperture comprising a slot with opposed recesses, the cylindrical member having opposed proturberances radially proximate to the recesses, wherein the proturberances operate to deform the recesses upon receiving a pin from a cooperating connector.

2. The insulative shroud retention wafer of claim 1, wherein the proturberance comprises a wall having arcuate upper sections.

3. The insulative shroud retention wafer of claim 1, wherein the wall has an upper edge that slopes laterally and downward toward the planar base.

4. The insulative shroud retention wafer of claim 1, wherein the arcuate upper sections curve inwardly toward the cylindrical member to form a cam.

5. The insulative shroud retention wafer of claim 1, wherein the recesses are substantially triangular to closely receive the pin.

6. The insulative shroud retention wafer of claim 1, wherein recesses are substantially semicircular.

7. The insulative shroud retention wafer of claim 1, wherein the opposed proturberances comprise material added to the cylindrical member.

8. The insulative shroud retention wafer of claim 1, wherein the cylindrical member comprises 8 mils of plastic at a location 90 degrees from the protuberances.

9. The insulative shroud retention wafer of claim 1, wherein the cylindrical members are arranged in an array of rows and columns extending from the first side of the planar base.

10. The insulative shroud retention wafer of claim 1, wherein the cylindrical member comprises a central body surrounding the aperture.

11. An electrical connector having an insulative shroud retention wafer comprising:

a planar base having a first and a second side;

at least one cylindrical member extending from the first side of the planar base, the cylindrical member comprising an aperture for accepting a pin, the aperture comprising a slot with opposed recesses, the cylindrical member having opposed proturberances radially proximate to the recesses; and a conductive pin extending through said aperture, wherein the proturberances deform the recesses upon receiving the conductive pin.

* * * * *